US006044869A

United States Patent [19]

Koob

[11] Patent Number: 6,044,869

[45] Date of Patent: Apr. 4, 2000

[54] INJECTION HOSE FOR CONCRETE CONSTRUCTION JOINTS

[75] Inventor: Kunibert Koob, Alpen, Germany

[73] Assignee: BBZ Injektions- und Abdichtungstechnik GmbH, Willich, Germany

[21] Appl. No.: 08/619,775

[22] PCT Filed: Sep. 22, 1994

[86] PCT No.: PCT/EP94/03174

§ 371 Date: May 16, 1996

§ 102(e) Date: May 16, 1996

[87] PCT Pub. No.: WO95/08680

PCT Pub. Date: Mar. 30, 1995

[30] Foreign Application Priority Data

Sep. 24, 1993 [DE] Germany ..... 43 32 589

[51] Int. Cl.[7] ..... F16L 9/00

[52] U.S. Cl. ..... 138/177; 138/123; 138/125; 138/103; 239/145

[58] Field of Search ..... 138/177, 178, 138/123, 124, 126; 239/145, 568

[56] References Cited

U.S. PATENT DOCUMENTS

| | | | |
|---|---|---|---|
| 2,994,482 | 8/1961 | Valois et al. | 239/568 X |
| 3,946,762 | 3/1976 | Green | 138/140 |
| 4,061,272 | 12/1977 | Winston | 239/145 |
| 4,153,080 | 5/1979 | Murray, Jr. et al. | 239/145 X |
| 4,581,137 | 4/1986 | Edwards et al. | 239/145 X |
| 4,722,479 | 2/1988 | Koob | 239/145 |
| 5,660,209 | 8/1997 | Franz et al. | 239/145 X |

FOREIGN PATENT DOCUMENTS

| | | |
|---|---|---|
| 84 25 518 | 11/1984 | Germany . |
| 35 12 470 | 10/1986 | Germany . |
| 42 26 938 | 9/1993 | Germany . |

OTHER PUBLICATIONS

German Search Report dated Aug. 2, 1994.

*Primary Examiner*—Patrick Brinson
*Attorney, Agent, or Firm*—Alix, Yale & Ristas, LLP

[57] ABSTRACT

An injection hose (1) for concrete construction joints has a substantially liquid-tight base body (2) made of a flexible material such as rubber or plastics that encloses a passage (3). The outer surface (4) of the base body (2) is provided with at least one groove-shaped recess (5) that extends over its whole length. Radial outlets (6) for the liquid injected through the passage (3) are distributed over the length of the recess (5). A strip made of a material that may be compressed under the inner pressure of the injection liquid is received in the recess (5) and covers the outlets (6). A liquid-permeable sheath (8) surrounds the base body (2) and the strip, in the manner of a hose. A single recess (5) extends with a predetermined pitch along a spiral path around the outer surface (4) of the base body (2) or extends parallel to the axis of the passage (3) but has an opening angle of more than 90°.

20 Claims, 1 Drawing Sheet

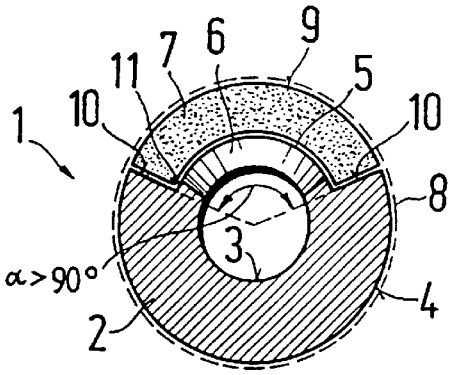
Fig. 3
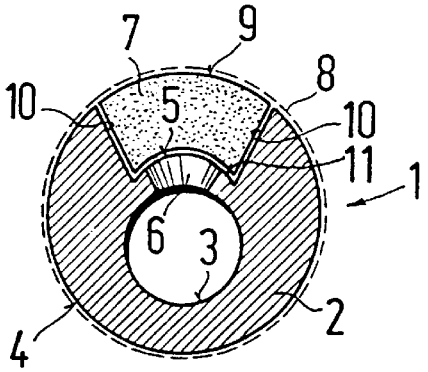
Fig. 2
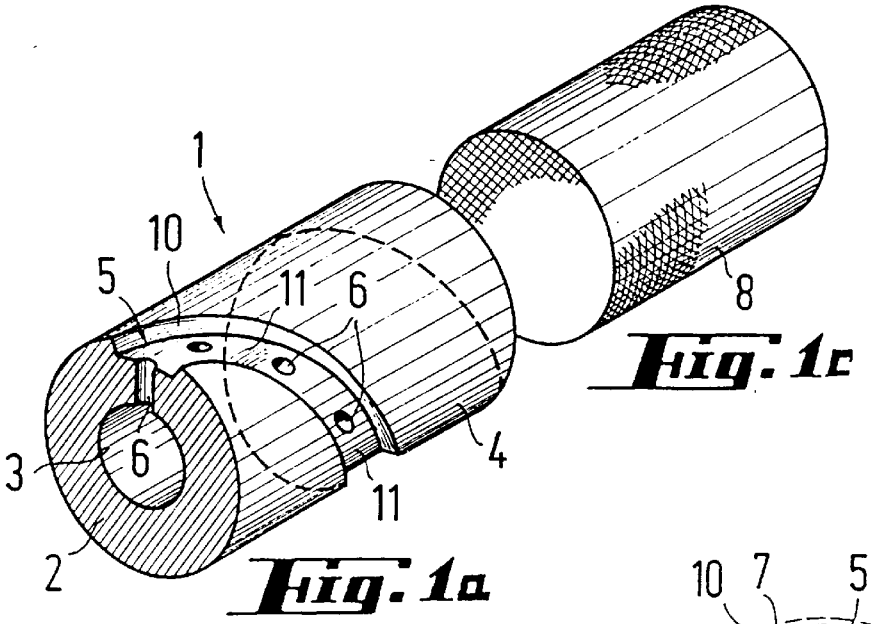
Fig. 1c
Fig. 1a
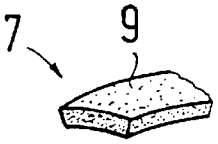
Fig. 1b
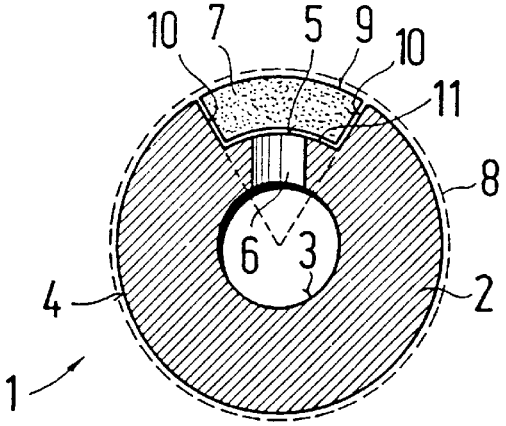
Fig. 1d

INJECTION HOSE FOR CONCRETE CONSTRUCTION JOINTS

CROSS-REFERENCES TO RELATED APPLICATIONS

This application claims priority from PCT International Application No. PCT/EP94/03174 filed on Sep. 22, 1994. The PCT Application claims priority from German Application P4332589.0 filed Sep. 24, 1993.

BACKGROUND OF THE INVENTION

An injection tube for construction joints on concrete buildings is known from DE-U 8,425,518, having an essentially cylindrical wall which is permeable to liquid and is made of flexible material, such as rubber or plastic, in which the wall has a slot, extending over its length, for the outlet of the injection liquid, the wall in the region of the slot has a depression, extending axially likewise over the length of the wall, for receiving a strip which covers the slot and is made of a material which is compressible under the pressure of the injection liquid, and in which the wall with the strip is enclosed by a tube of material which is permeable to liquid. Such an injection tube has disadvantages in terms of manufacture and, owing to the relatively narrow outlet slot compared to the width of the depression, relatively high compression forces are required without being able to achieve a reliably uniform distribution of the injection liquid over the circumference of the injection tube.

These disadvantages are avoided to a great extent in the injection tube known from DE-A 3,512,470, in that a plurality of radial openings in the basic body and the assigned depressions and strips are distributed over the circumference of the basic body with angular symmetry in relation to the longitudinal mid-axis. However, this requires greater production expenditure.

SUMMARY OF THE INVENTION

The object of the invention is to propose an injection tube of the type mentioned at the beginning, which, with simple manufacture and relatively low compression forces, allows a uniform distribution of the injection liquid over the circumference of the injection tube so that construction joints can be grouped reliably, even using cement.

This object is achieved according to the invention by the characterizing features of claim 1 or claim 3.

With the aid of both solutions, the production of the injection tube is simplified since only a single depression has to be provided in the casing surface of the basic body, on the other hand the disadvantages of a continuous slot in the basic body are avoided because radial passage openings distributed over the length of the basic body are provided, and an exceptionally uniform distribution of the injection liquid over the circumference of the injection tube is surprisingly achieved either due to the helical shape of the depression or the relatively large width of the depression, so that construction joints can be sealed off with greater reliability. Particularly if the relatively wide depression runs axially parallel to the passage channel, to use less material provision may be made for the passage channel to be arranged eccentrically in the cylindrical basic body.

It is particularly advantageous if the covering consists of a large-mesh, low-stretch fabric which tightly surrounds the casing surface of the basic body and the outer surface of the strip because, in this way, the injection tube does not undergo any circumferential widening at all during compression of the injection liquid, but only an internal valve effect occurs due to the squeezing of the strip material. This is because the strip, which closes the openings in the groove-shaped depression when there is an external pressure, for example the pressure of the concrete, specifically all the better, the greater the external pressure is, is compressed from the inside under the compression force in such a way that the injection liquid can easily emerge. In this case, owing to the low-stretch fabric, the injection tube cannot change its cross-section, which could otherwise lead to incomplete sealing of the construction joint.

In terms of manufacture, it is advantageous if the strip is bonded under prestress into the depression.

Within the scope of the invention, the lateral boundary flanks of the depression and of the strip can advantageously taper obliquely towards one another from radially outside to radially inside in a manner known per se. In this case, a particularly favourable opening cross-section results when there is a compression force from the inside, and a particularly reliable sealing of the passage channel results when there is pressure from the outside.

The opening cross-section can also be favourably influenced in the case of reliable sealing due to the fact that the width of the base area of the depression is only slightly larger than the diameter of the openings.

In a particular design of the invention, the depression and the strip have an essentially mutually corresponding, trapezoidal cross-section with a slightly curved base area and a curved outer surface corresponding to the tube circumference so that, in the state of rest, the strip virtually completely fills the depression.

The distance between the radial openings in the depression is in the order of magnitude of 1 to 3 cm, their diameter between about 3 and 5 mm. A diameter of between about 5 and 10 mm is expedient for the cross-section of the passage channel, depending on the grouting material. The depth of the depression is approximately in the order of magnitude of between 2 and 5 mm. This then also corresponds to the thickness of the strips in the non-compressed state. A suitable material for the basic body is, in particular, polyvinyl chloride, for the strip foam rubber, sponge rubber or neoprene. The tube-like covering can be a large-mesh, low-stretch braided fabric.

BRIEF DESCRIPTION OF THE DRAWING

The invention will subsequently be further described with reference to exemplary embodiments and the drawing.

FIG. 1*a* shows an oblique view of the basic body of an injection tube exhibiting the invention according to a first embodiment, FIG. 1*b* shows a cut-away view of a strip for arrangement in the groove-like, hectically encircling depression of the basic body according to FIG. 1*a,*

FIG. 1*c* shows the section of a tube-like covering for the basic body according to FIG. 1*a* after insertion of the strip according to FIG. 1*b* in the groove-like, hectically encircling depression, FIG. 1*d* shows a cross-section through an injection tube exhibiting the invention according to the first embodiment after assembly of the parts according to FIGS. 1*a* to 1*b,*

FIG. 2 shows a cross-section similar to FIG. 1*d* for another design of the invention, FIG. 3 shows a section corresponding to FIG. 1*d* for a further design of the invention and FIG. 4 shows a cross-section similar to FIG. 3 and including a passage channel arranged eccentrically in the body.

DESCRIPTION OF THE PREFERRED EMBODIMENTS

The injection tube 1 consists of a basic body 2 which has an essentially hollow-cylindrical wall and thus forms a continuous, either central (FIGS 1*a*, 1*d* and 3) or eccentric, axially parallel, cylindrical passage channel 3. An injection liquid, which later hardens, is pressed through the passage channel 3 from one end or both ends of the injection tube 1 or, if appropriate, in the case of connections provided between said ends also from the latter in order to distribute it over the length of a construction joint, to be sealed off, of a concrete building, into which construction joint the injection tube 1 is inserted. According to FIGS 1*a* and 1*d*, the outer casing surface 4 of the basic body 2 is fitted with a groove-like, hectically encircling depression 5 extending over the length of the basic body 2. opening out into the depression 5 are radial openings 6, distributed over the length of the depression, for the outlet of injection liquid from the passage channel 3 into the construction joint to be sealed off. An elongate strip 7 covering the openings 6 (FIG. 1*b*) is inserted in the depression 5. The strip 7 consists of a material, such as neoprene, which is compressible under the internal pressure (compression force) of the injection liquid. In order to hold the strip 7 in the depression 5 and to avoid widening of the cross-section of the injection tube 1, even during compression, the basic body 2 with the inserted strip 7 is tightly enclosed by a tube-like covering 8 which is permeable to liquid. Owing to the fact that the single depression 5 encircles the basic body hectically, the injection liquid can emerge, during compression, distributed uniformly virtually over the entire circumference of the injection tube 1 despite using only a single strip 7. The covering 8 preferably consists of a large-mesh, low-stretch fabric which tightly surrounds the casing surface 4 of the basic body 2 and the outer surface 9 of the strip 7 and prevents yielding of the strip 7, even under increased internal pressure (compression force). The large-mesh design of the fabric guarantees an unimpeded outlet of the injection liquid during compression over the entire circumference of the injection tube 1 while it conversely allows a pressure from the outside, for example of the concrete, on the strip 7, as a result of which the latter is pressed firmly into the depression 5 and sealing of the injection tube 1 from the outside is ensured so that no disadvantageous materials can pass into the passage channel 3 and block it. By means of the solution according to the invention, an internal valve device is therefore provided which is functional at any time and guarantees a uniform distribution of the injection liquid during the grouting of a construction joint to be sealed off, without widening of the cross-section of the injection tube.

If, as can be seen from FIG. 2, the passage channel 3 is arranged eccentrically in the cylindrical basic body 2, the tube cross-section can have a relatively small cross-section despite a relatively large thickness of the strip 7 and therefore a good opening and closing function. In this case, the embodiment according to FIG. 2 relates to an injection tube 1, in which the depression 5 and the strip 7 run axially parallel to the passage channel 3, and the depression 5 has an opening width a of less or more than 90°.

The embodiment illustrated in FIG. 3 is likewise an injection tube 1 whose depression 5 and strip 7 run axially parallel to the passage channel 3, but the depression 5 extends over an opening width a of more than 90° so that, in this way, a sufficiently uniform distribution of the injection liquid can be achieved over the circumference of the injection tube 1 during compression.

It is common to all the special designs illustrated that the lateral boundary flanks 10 of the depression 5 and of the strip 7 run obliquely towards one another from radially outside to radially inside. The depression 5 and the strip 7 then preferably have an essentially mutually corresponding, trapezoidal cross-section with a slightly curved base area 11 of the strip 7 or of the depression 5 and a curved outer surface 9 of the strip 7 corresponding to the tube circumference. It is also common to all the designs that the width of the base area 11 of the depression 5 is only slightly larger than the diameter of the radial openings 6, such that the internal valve device of the injection tube 1 according to the invention already opens at relatively low compression forces, but on the other hand reliable sealing is guaranteed when the strip 7 is pressurized from the outside. Instead of the trapezoidal cross-section of the depression, the latter can, of course, also have any desired other shape as long as it is suitable to receive a corresponding, compressible strip, a round cord or the like. For example, it can be shaped to be semicircular, oval or the like.

I claim:

1. An injection tube (1) for construction joints on concrete buildings comprising:

a basic body (2) comprising a flexible material which is essentially impermeable to liquid, said basic body surrounding a passage channel (3) and having an outer casing surface (4), at least one groove-like depression (5) extending over the length of the basic body (2), one said depression (5) hectically encircling the outer casing surface (4) of the basic body (2) with a predetermined pitch;

a plurality of radial openings (6) fluidly connecting the passage channel (3) to the depression (5) over the length of the depression (5), said openings providing an outlet for a liquid injected into the passage channel (3);

said depression (5) receiving a strip (7) comprising a material which is compressible under the internal pressure of the injection liquid, said strip (7) covering the openings (6); and a covering (8) which is permeable to liquid enclosing the basic body (2) and the strip (7).

2. An injection tube (1) for construction joints on concrete buildings comprising:

a basic body (2) comprising a flexible material which is essentially impermeable to liquid, said basic body surrounding a passage channel (3) and having an outer casing surface (4), at least one groove-like depression (5) extending over the length of the basic body (2), one said depression (5) running axially parallel to the passage channel (3) and having an opening width of more than 90°;

a plurality of radial openings (6) fluidly connecting the passage channel (3) to the depression (5) over the length of the depression (5), said openings providing an outlet for a liquid injected into the passage channel (3);

said depression (5) receiving a strip (7) comprising a material which is compressible under the internal pressure of the injection liquid, said strip (7) covering the openings (6); and a covering (8) which is permeable to liquid enclosing the basic body (2) and the strip (7).

3. An injection tube according to claim 1, wherein the passage channel (3) is arranged eccentrically in the cylindrical basic body (2).

4. An injection tube according to claim 1, wherein the covering (8) consists of a large-mesh, low-stretch fabric which tightly surrounds the casing surface (4) of the basic body (2) and an outer surface of the strip (7).

5. An injection tube according to claim 1, wherein the strip (7) is bonded under prestress into the depression (5).

6. An injection tube according to claim 1, wherein the depression (5) and the strip (7) have lateral boundary flanks which taper obliquely towards one another from radially outside to radially inside.

7. An injection tube according to claim 1, wherein the depression (5) has a base area and the width of the base area (11) of the depression (5) is only slightly larger than a diameter of the openings (6).

8. An injection tube according to claim 1, wherein the depression (5) and the strip (7) have an essentially mutually corresponding, trapezoidal cross-section with a slightly curved base area (11) and a curved outer surface (9) corresponding to the tube circumference.

9. An infection tube according to claim 2, wherein the covering (8) consists of a large-mesh, low-stretch fabric which tightly surrounds the casing surface (4) of the basic body (2) and an outer surface of the strip (7).

10. An injection tube according to claim 9, wherein the strip (7) is bonded under prestress into the depression (5).

11. An injection tube according to claim 10, wherein the depression (5) and the strip (7) have lateral boundary flanks which taper obliquely towards one another from radially outside to radially inside.

12. An injection tube according to claim 11, wherein the depression (5) has a base area and the width of the base area (11) of the depression (5) is only slightly larger than a diameter of the openings (6).

13. An injection tube according to claim 12, wherein the depression (5) and the strip (7) have an essentially mutually corresponding, trapezoidal cross-section with a slightly curved base area (11) and a curved outer surface (9) corresponding to the tube circumference.

14. An injection tube according to claim 2, wherein the passage channel (3) is arranged eccentrically in the cylindrical basic body (2).

15. An injection tube according to claim 3, wherein the depression (5) and the strip (7) have lateral boundary flanks which taper obliquely towards one another from radially outside to radially inside.

16. An injection tube according to claim 3, wherein the depression (5) has a base area and the width of the base area (11) of the depression (5) is only slightly larger than a diameter of the openings (6).

17. An injection tube according to claim 3, wherein the depression (5) and the strip (7) have an essentially mutually corresponding, trapezoidal cross-section with a slightly curved base area (11) and a curved outer surface (9) corresponding to the tube circumference.

18. An injection tube according to claim 2, wherein the depression (5) and the strip (7) have lateral boundary flanks which taper obliquely towards one another from radially outside to radially inside.

19. An injection tube according to claim 2, wherein the depression (5) has a base area and the width of the base area (11) of the depression (5) is only slightly larger than the diameter of the openings (6).

20. An injection tube according to claim 2, wherein the depression (5) and the strip (7) have an essentially mutually corresponding, trapezoidal cross-section with a slightly curved base area (11) and a curved outer surface (9) corresponding to the tube circumference.

* * * * *

UNITED STATES PATENT AND TRADEMARK OFFICE

CERTIFICATE OF CORRECTION

PATENT NO. : 6,044,869
DATED : April 4, 2000
INVENTOR(S) : Koob

It is certified that error appears in the above-identified patent and that said Letters Patent is hereby corrected as shown below:

Column 5,
Line 18, delete "infection" and substitute -- injection --.

Signed and Sealed this

Second Day of May, 2006

JON W. DUDAS
*Director of the United States Patent and Trademark Office*